US011583913B2

(12) United States Patent
Lerch et al.

(10) Patent No.: US 11,583,913 B2
(45) Date of Patent: Feb. 21, 2023

(54) TOOL FOR INTERNAL HIGH-PRESSURE SHAPING AND METHOD FOR SHAPING A WORKPIECE BY INTERNAL HIGH-PRESSURE SHAPING

(71) Applicant: Bayerische Motoren Werke Aktiengesellschaft, Munich (DE)

(72) Inventors: Johann-Stefan Lerch, Hohenwart (DE); Thomas Schmolke, Vilsbiburg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 341 days.

(21) Appl. No.: 16/253,878

(22) Filed: Jan. 22, 2019

(65) Prior Publication Data

US 2019/0151925 A1 May 23, 2019

Related U.S. Application Data

(63) Continuation of application No. PCT/EP2017/074198, filed on Sep. 25, 2017.

(30) Foreign Application Priority Data

Oct. 17, 2016 (DE) ..... 10 2016 220 221.9

(51) Int. Cl.
*B21D 26/047* (2011.01)
*B21D 53/88* (2006.01)
*B21D 26/033* (2011.01)

(52) U.S. Cl.
CPC ..... *B21D 26/047* (2013.01); *B21D 26/033* (2013.01); *B21D 53/88* (2013.01)

(58) Field of Classification Search
CPC ..... B21D 26/047; B21D 26/033; B21D 53/88
See application file for complete search history.

(56) References Cited

U.S. PATENT DOCUMENTS 5,960,659 A 10/1999 Hartman et al.
6,209,372 B1 * 4/2001 Freeman ..... B21D 26/033 72/58

(Continued)

FOREIGN PATENT DOCUMENTS

CN 1644264 A 7/2005
CN 105163879 A 12/2015

(Continued)

OTHER PUBLICATIONS

International Search Report (PCT/ISA/210) issued in PCT Application No. PCT/EP2017/074198 dated Dec. 21, 2017 with English translation (four (4) pages).

(Continued)

*Primary Examiner* — Teresa M Ekiert
(74) *Attorney, Agent, or Firm* — Crowell & Moring LLP

(57) ABSTRACT

A tool for the internal high-pressure shaping of a workpiece, in particular for producing a tubular structural component for a motor vehicle, is provided. The tool includes at least three movable tool segments, which bound a shaping cavity for accommodating and shaping the workpiece. The movable tool segments, at least in some sections, completely form the shaping cavity in a closed state of the tool. A method for shaping a workpiece by internal high-pressure shaping is also provided.

7 Claims, 4 Drawing Sheets

(56) References Cited

U.S. PATENT DOCUMENTS

| | | | | |
|---|---|---|---|---|
| 6,415,638 | B1 | 7/2002 | Sakurai et al. | |
| 6,434,990 | B1 * | 8/2002 | Juedes | B21D 15/10 285/256 |
| 6,966,209 | B1 | 11/2005 | Schulze | |
| 2013/0098129 | A1 * | 4/2013 | Golovashchenko | B21D 26/033 72/58 |
| 2014/0196514 | A1 * | 7/2014 | Hu | B21D 26/041 72/61 |
| 2015/0343519 | A1 * | 12/2015 | Colosseo | B21D 26/047 29/888.1 |
| 2016/0023261 | A1 | 1/2016 | Lerch et al. | |

FOREIGN PATENT DOCUMENTS

| | | | |
|---|---|---|---|
| DE | 94 11 461 | U1 | 9/1994 |
| DE | 694 03 722 | T2 | 9/1997 |
| DE | 197 08 905 | A1 | 4/1998 |
| DE | 199 07 247 | A1 | 8/2000 |
| DE | 100 14 619 | A1 | 10/2000 |
| DE | 100 38 717 | C1 | 7/2001 |
| TW | 201427777 | A | 7/2014 |

OTHER PUBLICATIONS

German-language Written Opinion (PCT/ISA/237) issued in PCT Application No. PCT/EP2017/074198 dated Dec. 21, 2017 (four (4) pages).

German-language Search Report issued in counterpart German Application No. 102016220221.9 dated Jul. 12, 2017 with partial English translation (12 pages).

English translation of Chinese Office Action issued in counterpart Chinese Application No. 201780044248.X dated Nov. 13, 2019 (seven pages).

* cited by examiner

Prior Art

Prior Art

TOOL FOR INTERNAL HIGH-PRESSURE SHAPING AND METHOD FOR SHAPING A WORKPIECE BY INTERNAL HIGH-PRESSURE SHAPING

CROSS REFERENCE TO RELATED APPLICATIONS

This application is a continuation of PCT International Application No. PCT/EP2017/074198, filed Sep. 25, 2017, which claims priority under 35 U.S.C. § 119 from German Patent Application No. 10 2016 220 221.9, filed Oct. 17, 2016, the entire disclosures of which are herein expressly incorporated by reference.

BACKGROUND AND SUMMARY OF THE INVENTION

The invention relates to a tool for hydroforming workpieces. It also relates to a method for forming a workpiece by hydroforming.

In hydroforming, for example a metallic initial tube part is formed into a tubular component, or hydroformed component, by virtue of a high internal pressure being applied. For this purpose, the initial tube part is positioned in the cavity of a shaping hydroforming tool and, with the aid of a fluid, for example a water/oil emulsion, introduced into the interior, is widened essentially transversely to the longitudinal axis, wherein the lateral casing of the initial tube part is pushed against the cavity wall and correspondingly shaped in the process.

DE 197 08 905 A1 discloses, in particular in conjunction with FIG. 2, an apparatus for hydroforming a hollow vehicle-body support, where the apparatus includes two tool halves with a parting line between them.

The disadvantage with the known methods and apparatuses used for hydroforming is that the components which are to be produced have to be designed such that they do not have any undercut in the closing direction of the press, for closing the tool halves.

Furthermore, the operation of coordinating the parting line running between the two tool halves is a very laborious one. For example, an offset can result in quality being impaired or even in the component failing.

Furthermore, it is often necessary, in particular if the hydroformed component has a complex shape, in the first instance for a preforming operation to be carried out in one or more process steps, wherein the initial tube part is used to generate a preformed initial tube part for the subsequent hydroforming operation in the hydroforming tool. If, for example, the component cross section tapers in relation to the initial part, preforming for example by way of deep-cavity molding is imperative.

DE 100 14 619 A1 discloses, in conjunction with FIG. 26, a hydroforming apparatus which has four fixed, immovable and spaced-apart molds with concave surfaces and four movable dies, which are each arranged between the fixed molds. The disadvantage with this apparatus is, for example, that, on account of the fixed molds, the workpieces which are to be formed have to be pushed axially into the apparatus. On account of the fixed molds, which come into contact with the workpiece during the forming operation, fixed component radii are predetermined. Furthermore, in addition, a preforming operation cannot always be avoided. It is also the case that the operation of coordinating the parting lines between the fixed molds and the movable dies is a very laborious one.

Proceeding from the prior art, it is therefore one object of at least a number of embodiments to specify a tool which is intended for hydroforming workpieces and as a result of which it is possible to dispense with preforming process steps and/or as a result of which it is also possible to produce undercut components and/or as a result of which it is possible to dispense with laborious coordination of the parting line. A further object is that of specifying a method for shaping a workpiece by hydroforming.

These and other objects are achieved by embodiments of the invention. Advantageous embodiments and developments can also be gathered from the independent and/or dependent claims, the following description and from the drawings.

According to at least one embodiment, a tool described here for hydroforming a workpiece has at least three movable tool segments. The workpiece can be, in particular, a hollow body, for example a metallic, tubular hollow body. Following the operation of forming by hydroforming, the shaped component can be used, for example, as a structural component for a motor vehicle.

The movable tool segments delimit a shaping cavity for accommodating and forming the workpiece. The tool can have one or more open states and a closed state. In the closed state, preferably at least part of the tool forms a fully closed cavity.

It is preferably the case, in the closed state of the tool, that at least parts of the movable tool segments fully form the shaping cavity. In other words, at least parts of the at least three movable tool segments alone form the closed cavity. In the closed state of the tool, at least parts of the at least three movable tool segments can fully form the shaping cavity such that, in an imaginary cross-sectional plane, a closed encircling cavity outline is formed by the movable tool segments. Furthermore, in the closed state of the tool, the movable tool segments can fully form the cavity not just in part, but over the entire cavity, and therefore the movable tool segments form a closed encircling cavity outline over the entire cavity in any possible imaginary cross-sectional plane.

According to a further embodiment, in the closed state of the tool, each of the movable tool segments is in direct contact with two further movable tool segments. In the closed state of the tool, the movable tool segments can be in contact with further movable tool segments in each case in particular in regions which are directly adjacent to the surface of the cavity, and therefore, in the closed state, a closed cavity is formed by the movable tool segments alone.

According to a further embodiment, the tool is designed such that, when a workpiece is being formed, the parting lines, which are arranged between two movable tool segments in the closed state of the tool, are not in direct contact with the workpiece. It is preferably the case that none of the parting lines, which are arranged between two directly adjacent tool segments, are in contact with the workpiece during the forming process. Consequently, the tool construction involved here can be one without a parting line or component corner radii. Since the workpiece is not in contact with a parting line, it is advantageously possible to achieve better quality of the component which is to be produced.

According to a further embodiment, the tool has four movable tool segments and, in the closed state of the tool, at least parts of said four movable tool segments fully form the shaping cavity. It is preferably the case that, in the closed state of the tool, the four movable tool segments fully form the cavity over the entire cavity, and therefore, in an imaginary cross-sectional plane, a closed encircling cavity outline is formed by the four movable tool segments.

As a result of the tool described here, it is advantageously possible to dispense with process steps for preforming the workpiece. Furthermore, the tool described here also makes it possible to produce, for example, components with undercuts.

Also specified is a method for forming a workpiece by hydroforming. The method supplies a workpiece which is to be formed and also a tool which is described here. The tool can have one or more features from the aforementioned embodiments. The features described up until now, and hereinbelow, can apply both to the hydroforming tool and to the method for forming a workpiece.

As far as the method is concerned, the workpiece which is to be formed is introduced into the tool when the latter is in an open state, it therefore being arranged between the tool segments. Furthermore, the workpiece is formed in the tool using high internal fluid pressure, wherein, during the forming operation, the at least three movable segments of the tool are in direct contact with the workpiece. The high internal pressure can be introduced into the workpiece, designed in the form of a hollow body, for example by a water/oil emulsion.

According to a further embodiment, in the closed state of the tool, the movable tool segments form a closed encircling cavity outline in an imaginary cross-sectional plane.

In the closed state of the tool, the movable tool segments preferably form a cavity, wherein, during the forming operation, at least part of the workpiece is not in full contact with the surface of the cavity. In other words, the workpiece is preferably not in contact with the cavity to surface, or the deep cavity, over the entire circumference (100%).

For example, it is possible, in the closed state of the tool, for in each case two directly adjacent movable tool segments to define a parting line at the transition from one tool segment to the next tool segment, wherein the workpiece is not in direct contact with the tool segments preferably in the region of the parting lines. Since the component which is to be produced is not in contact with the parting lines, it is possible to achieve a better component quality.

Component radii of the workpiece in regions where there is no contact with the cavity surface, or deep cavity, can be controlled in a specific manner for example via process parameters, e.g., via the pressure or for example also via wall thicknesses.

The method described here is distinguished in that it is also possible to produce components with undercuts. Furthermore, it is advantageously possible to dispense with a workpiece-preforming operation.

Further advantages and advantageous embodiments of the tool described here for hydroforming a workpiece, and of a method described here for forming a workpiece by hydroforming will become apparent from the following detailed description of one or more preferred embodiments when considered in conjunction with the accompanying drawings.

DETAILED DESCRIPTION OF THE DRAWINGS

In the exemplary embodiments and figures, the same or equivalent constituent parts can each be provided with the same reference signs. The elements illustrated and the proportions thereof in relation to one another should basically be considered as not being to scale. Rather, to give a clear illustration and/or a better understanding, individual elements may be illustrated in exaggeratedly thick form or with exaggeratedly large dimensions.

Figure 1:
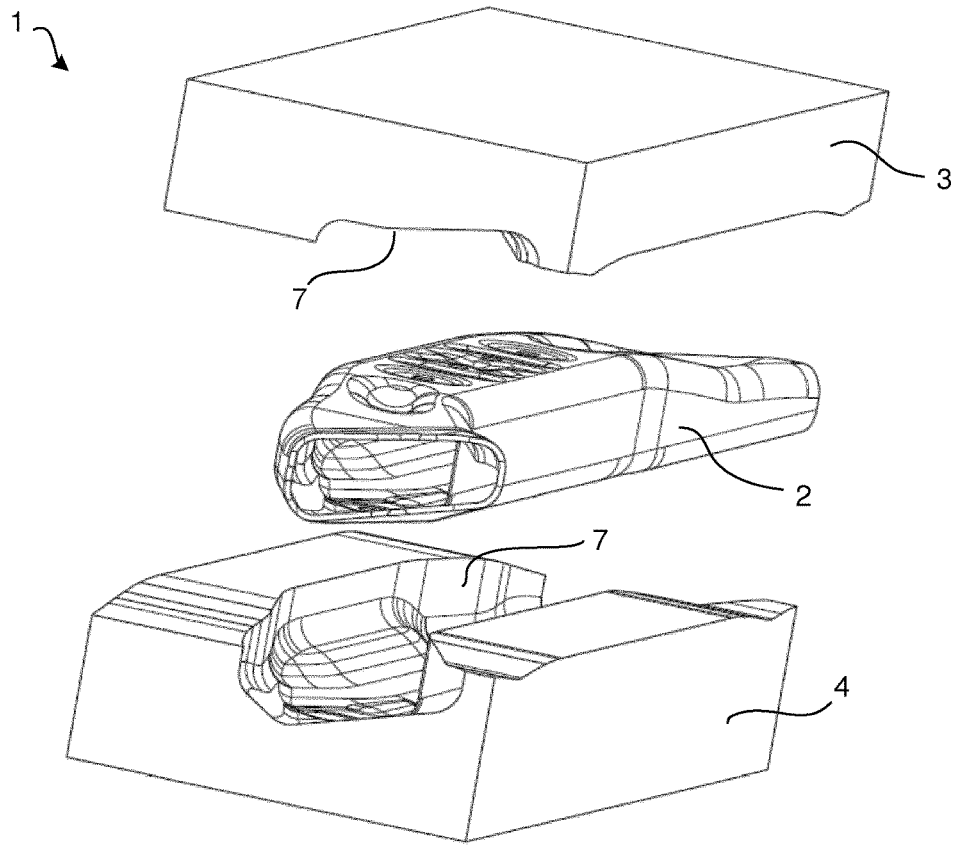
FIGS. 1 to 4 are various schematic illustrations of a prior-art tool for hydroforming a workpiece.
Figure 2:
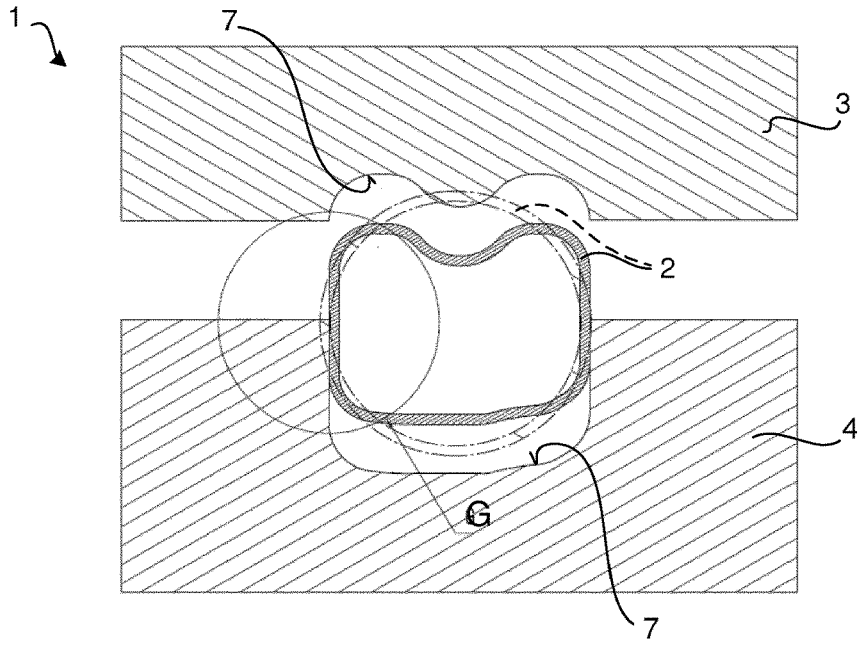
Prior Art Fig. 2
Figure 3:
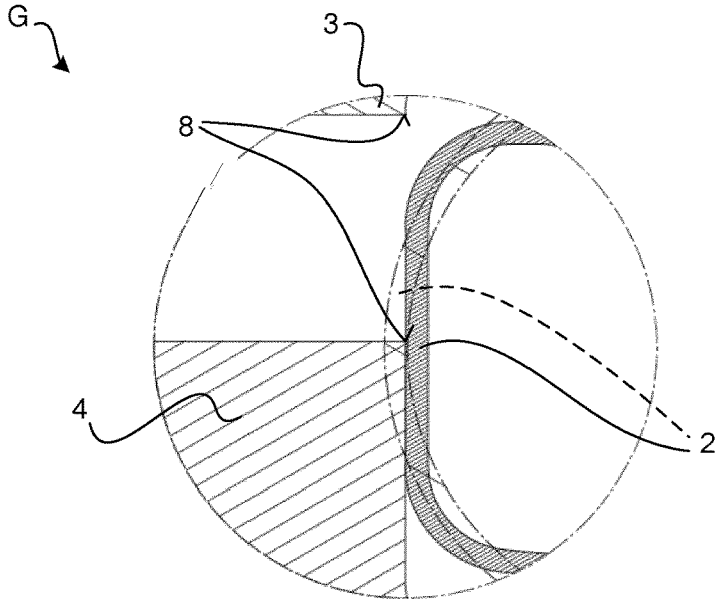
Figure 4:
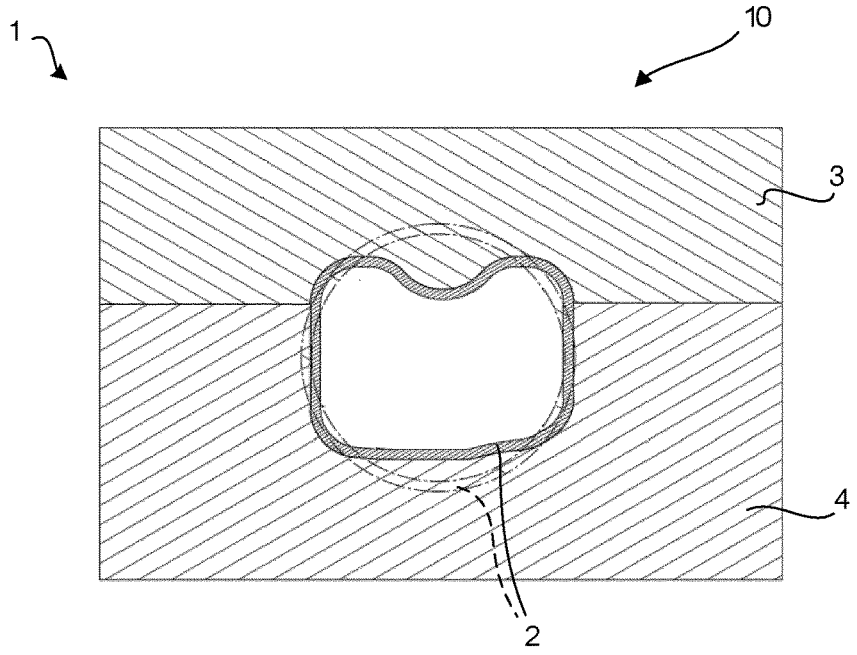
Prior Art Fig. 4

FIGS. 1 to 4 show schematic illustrations of various views of a prior-art tool 1, and of a method, for hydroforming a workpiece 2. FIG. 1 shows a schematic perspective illustration. FIGS. 2 to 4 show sectional illustrations, wherein FIG. 2 shows the tool 1 in an open state, FIG. 4 shows the tool 1 in the closed state, and FIG. 3 shows an enlarged detail G from FIG. 2.

The tool 1 has a first tool segment 3 and a second tool segment 4, in the closed state 10 of the tool 1, the two tool segments 3, 4 form a closed cavity 7. FIGS. 2 to 4 each show the workpiece 2 in two different illustrations, that is to say in an illustration prior to the forming operation and in an illustration following the forming operation.

The disadvantage with the method shown in conjunction with FIGS. 1 to 4 is that the parting line, which is formed between the tool segments 3, 4, is in direct contact with the workpiece 2 during the forming operation.

The operation of coordinating the parting line can be a very laborious one as far as the design or production of the tool 1 is concerned.

Furthermore, it is not possible for the tool 1 shown in conjunction with FIGS. 1 to 4 to form any undercut components. In addition, depending on the component, one or more process steps in which the workpiece 2 has to be performed may be necessary.

Figure 5:
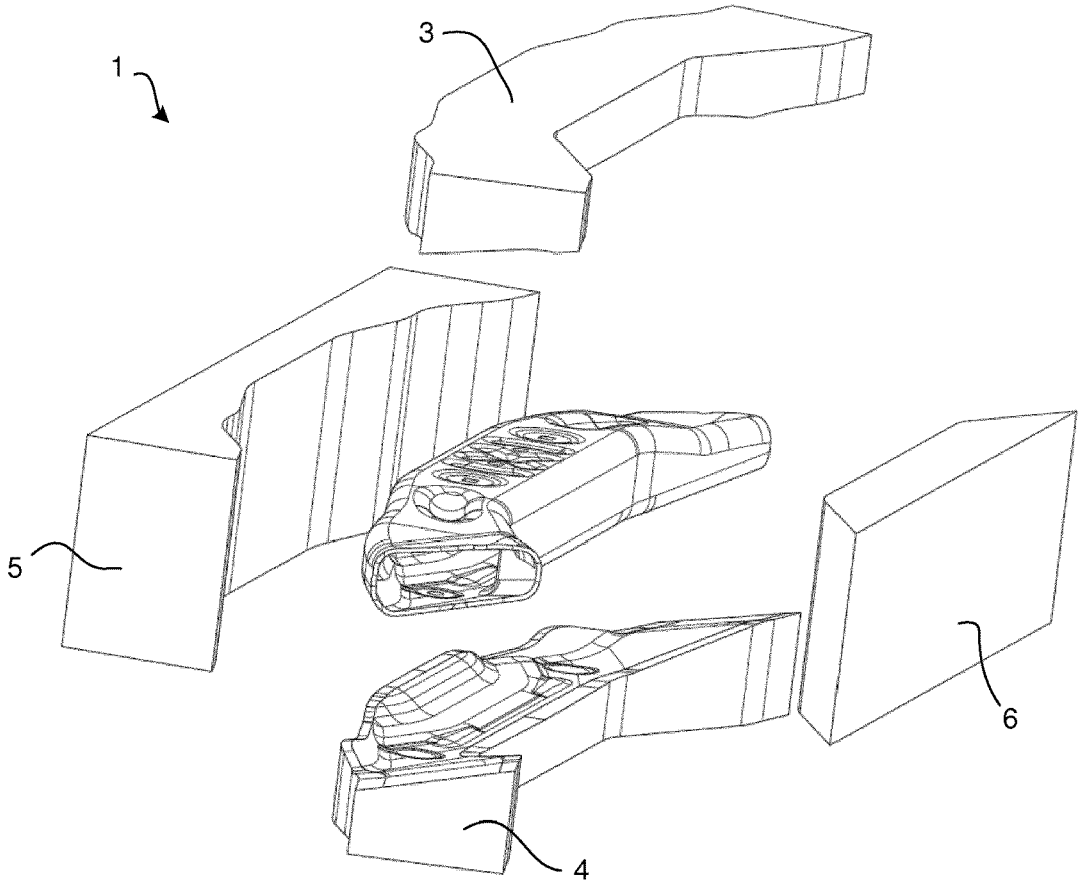
FIGS. 5 to 8 are various schematic illustrations of exemplary embodiments of a tool described here, and of a method described here.
Figure 6:
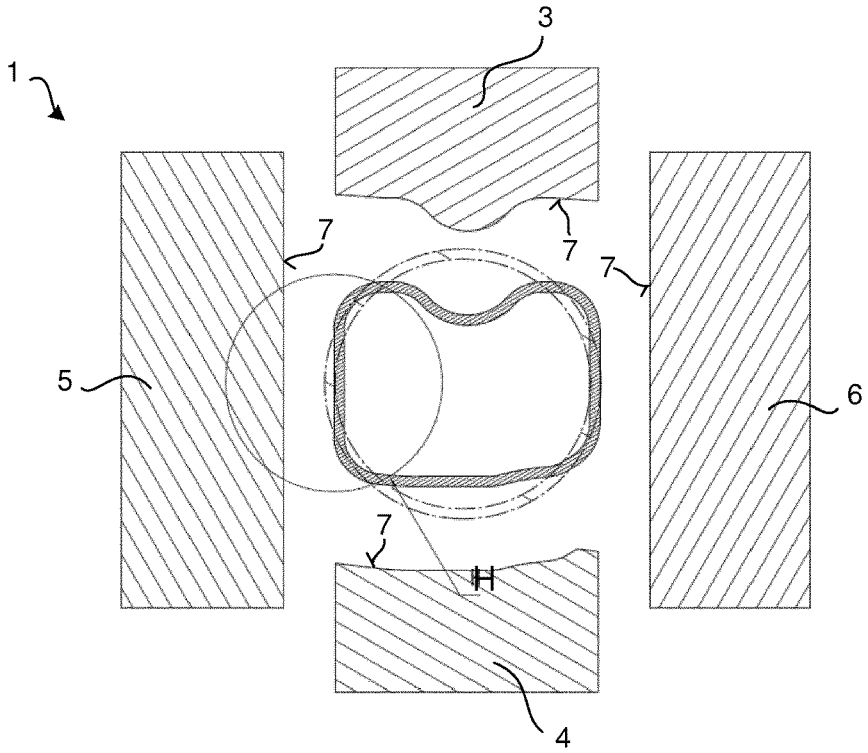
Figure 7:
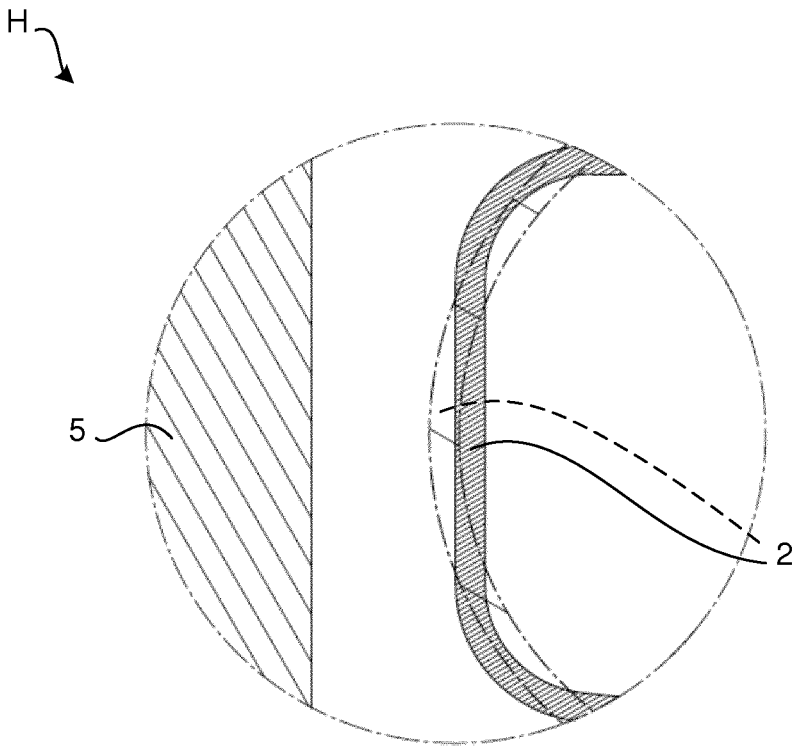
Figure 8:
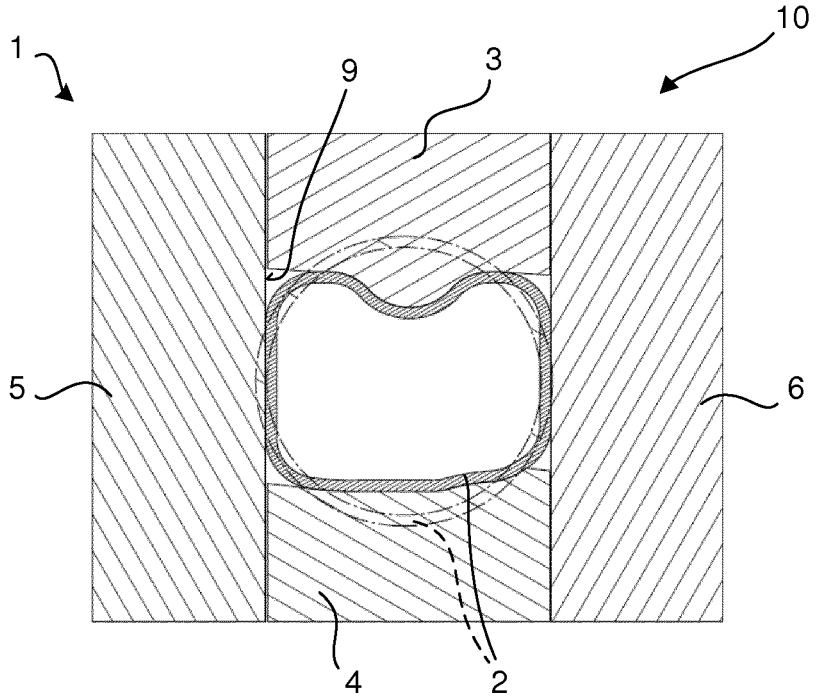

FIGS. 5 to 8 show various schematic illustrations of an exemplary embodiment of a tool 1 for hydroforming a workpiece 2. FIG. 5 here shows a perspective view of the tool 1 and of a workpiece 2 which is to be, and has been, formed. FIGS. 6 to 8 are sectional illustrations, wherein FIG. 6 shows the tool 1 in an open state, FIG. 8 shows the tool 1 in the closed state, and FIG. 7 shows an enlarged detail H from FIG. 6.

The tool 1 is designed in the form of a hydroforming tool and has four movable tool segments 3, 4, 5, 6, which delimit a shaping cavity 7 for accommodating and shaping a workpiece 2. In the closed state 10 of the tool 1, at least parts of the four movable tool segments 3, 4, 5, 6 fully form the shaping cavity, to be precise such that, in an imaginary cross-sectional plane, a closed encircling cavity outline is formed by the four movable tool segments 3, 4, 5, 6.

Furthermore, in the closed state 10 of the tool 1, the individual movable tool segments 3, 4, 5, 6 are each in direct contact with two further movable tool segments 3, 4, 5, 6.

When the workpiece 2 is being formed using a high internal fluid pressure, for example by virtue of a water/oil emulsion being introduced into the workpiece 2, designed in the form of a hollow body, the workpiece 2, in the closed state 10 of the tool 1, is not in contact throughout with the surface of the cavity 7. In particular in regions of the parting lines 8, which are formed between two tool segments 3, 4, 5, 6, the workpiece 2 is not in contact with surface subregions 9 of the cavity 7.

This advantageously makes it possible to dispense with laborious coordination of the parting lines 8. Furthermore, the risk of a component formed containing an offset on account of a poorly formed parting line 8 can be ruled out.

The tool 1 shown here in conjunction with FIGS. 5 to 8, and the method described in conjunction with FIGS. 5 to 8, is/are also advantageously suitable for forming workpieces 2 which have an undercut. Furthermore, the tool 1 can avoid preforming of workpieces 2, which is imperative in the prior art.

The features described in the exemplary embodiments shown can also be combined with one another in accordance with further exemplary embodiments. As an alternative, or in addition, the exemplary embodiments shown in the figures can have further features as per the embodiments of the general description.

LIST OF REFERENCE SIGNS

1 Tool
2 Workpiece
3 First tool segment
4 Second tool segment
5 Third tool segment
6 Fourth tool segment
7 Cavity
8 Parting line
9 Surface sub region
10 Closed state
G, H Enlarged detail The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for hydroforming a tubular hollow body, comprising:

a tool that includes:

four movable tool segments which delimit a shaping cavity for accommodating and forming the tubular hollow body, wherein, in a closed state of the tool, the four movable tool segments fully form the shaping cavity and at least a part of each of the four movable tool segments is in direct contact with a totally enclosed circumferential body that defines the tubular hollow body, wherein the tool is designed such that, the tubular hollow body is formed by a forming process in the tool by using a high internal fluid pressure, there is a respective parting line between two directly adjacent movable tool segments and no portion of any of the respective parting lines is in direct contact with the tubular hollow body such that the tubular hollow body is not in contact with any of the respective parting lines during an entirety of the forming process of the tubular hollow body in the tool by using the high internal fluid pressure.

2. The apparatus according to claim 1, wherein, in the closed state of the tool, at least parts of the four movable tool segments fully form the shaping cavity such that, in an imaginary cross sectional plane, a closed encircling cavity outline is formed by the four movable tool segments.

3. The apparatus according to claim 2, wherein, in the closed state of the tool, each of the four movable tool segments is in direct contact with two further movable tool segments.

4. The apparatus according to claim 1, wherein, in the closed state of the tool, each of the four movable tool segments is in direct contact with two further movable tool segments.

5. The apparatus according to claim 1, wherein the tubular hollow body is a tubular structural component for a motor vehicle.

6. A method for forming a tubular hollow body by hydroforming, the method comprising the acts of:

supplying a tool comprising:

four movable tool segments which delimit a shaping cavity for accommodating and forming the tubular hollow body, wherein, in a closed state of the tool, at least parts of the four movable tool segments fully form the shaping cavity;

supplying the tubular hollow body which is to be formed; and forming the tubular hollow body by a forming process in the tool using a high internal fluid pressure, wherein, during the forming process in the tool by using the high internal fluid pressure, at least a part of all of the four movable tool segments of the tool is in direct contact with a totally enclosed circumferential body that defines the tubular hollow body and there is a respective parting line between two directly adjacent movable tool segments, wherein no portion of any of the respective parting lines is in direct contact with the tubular hollow body such that the tubular hollow body is not in contact with any of the respective parting lines during an entirety of the forming process of the tubular hollow body in the tool by using the high internal fluid pressure.

7. The method according to claim 6, wherein, in the closed state of the tool, the four movable tool segments form a closed encircling cavity outline.

* * * * *